US006152002A

United States Patent [19]

Müller

[11] Patent Number: 6,152,002

[45] **Date of Patent: *Nov. 28, 2000**

[54] METHOD AND APPARATUS FOR TRIMMING FLAT PRINTED PRODUCTS ALONG A PREDETERMINED CUTTING LINE

[75] Inventor: Hans Müller, Zofingen, Switzerland

[73] Assignee: Grapha-Holding AG, Switzerland

[ * ] Notice: Under 35 U.S.C. 154(b), the term of this patent shall be extended for 498 days.

[21] Appl. No.: 08/514,377

[22] Filed: Aug. 11, 1995

[30] Foreign Application Priority Data

Aug. 12, 1994 [CH] Switzerland ..... 2489/94

[51] Int. Cl.[7] ..... B26D 1/56

[52] U.S. Cl. ..... 83/37; 83/300; 83/303; 83/404.2; 83/934

[58] Field of Search ..... 83/934, 404.1, 83/404.2, 408, 303, 300, 35, 328, 345, 39, 37; 493/362

[56] References Cited

U.S. PATENT DOCUMENTS

| | | | |
|---|---|---|---|
| Re. 28,840 | 6/1976 | Sarring | 83/934 |
| 1,359,076 | 11/1920 | Langston . | |
| 1,658,466 | 2/1928 | Sheldon . | |
| 2,208,350 | 7/1940 | Gustave et al. . | |
| 3,122,041 | 2/1964 | Kile et al. . | |
| 3,528,332 | 9/1970 | Thumin | 83/934 |
| 3,884,102 | 5/1975 | Faltin | 83/404.2 |
| 4,142,430 | 3/1979 | Long et al. | 83/35 |
| 4,300,427 | 11/1981 | Rathert | 83/934 |
| 4,387,614 | 6/1983 | Evans | 83/303 |
| 4,615,249 | 10/1986 | Geiser | 83/934 |
| 4,922,773 | 5/1990 | Ito | 83/934 |
| 5,377,569 | 1/1995 | Richards et al. | 83/934 |
| 5,586,479 | 12/1996 | Roy et al. | 83/404.1 |

FOREIGN PATENT DOCUMENTS

| | | | |
|---|---|---|---|
| 340 479 | 8/1959 | Germany . | |
| 1 105 384 | 4/1961 | Germany . | |
| 1 258 826 | 1/1968 | Germany . | |
| 1 266 275 | 4/1968 | Germany . | |
| 1266275 | 4/1968 | Germany | 83/934 |
| 1 930 903 | 1/1970 | Germany . | |
| 2 430 043 | 1/1975 | Germany . | |
| 1 206 851 | 12/1991 | Germany . | |
| 650 967 | 8/1985 | Switzerland . | |
| 738 039 | 10/1955 | United Kingdom . | |
| 813 436 | 5/1959 | United Kingdom . | |
| 2 078 593 | 1/1982 | United Kingdom . | |

OTHER PUBLICATIONS

Panorama, Müller Martini, Feb. 1995.

*Primary Examiner*—Kenneth E. Peterson
*Attorney, Agent, or Firm*—Venable; Robert Kinberg; Catherine M. Voorhees

[57] ABSTRACT

A method for trimming flat printed products along a predetermined cutting line includes the steps of continuously feeding the printed products in succession in a feed direction parallel to a plane defined by the printed products. The printed products are passed between two superposed knives, each knife having a cutting edge facing the other cutting edge. The two knives are moved in cutting engagement with one another in a direction that is substantially perpendicular to the plane of the printed products. The apparatus according to the invention includes a conveyor for continuously feeding the printed products in succession in a feed direction parallel to a plane defined by the printed products. At least one cutting device having two superposed knives is provided. Each knife has a cutting edge facing the other cutting edge. The printed products are passed by the conveyor between the two knives. A drive device moves at least one of the knives in cutting engagement with the other knife in a direction that is substantially perpendicular to the plane of the printed products.

31 Claims, 7 Drawing Sheets

METHOD AND APPARATUS FOR TRIMMING FLAT PRINTED PRODUCTS ALONG A PREDETERMINED CUTTING LINE

CROSS-REFERENCE TO RELATED APPLICATIONS

This application claims the priority of application Serial No. 02 489/94-4, filed in Switzerland on Aug. 12, 1994, the subject matter of which is incorporated herein by reference.

BACKGROUND OF THE INVENTION

The present invention relates to a method and apparatus for trimming flat products along a predetermined cutting line. The printed products are continuously fed in succession in a feed direction parallel to a plane defined by the printed products. The printed products are passed between two superposed knives, each knife having a cutting edge facing the other cutting edge.

Such methods and apparatuses are used to further process printed products, such as magazines, newspapers, brochures or books, and printed sheet for books. Trimming of the top, bottom and front edges of the printed products is traditionally performed after the magazines and newspapers are collated, or after the brochures or books and printed sheets for books are bound or stitched.

For example, Swiss Patent Application CH-A-650967 discloses an apparatus for trimming sheets of paper. The sheets of paper are transported lying on a plane of a feeder device or conveyor, through a cutting device, and along a predetermined cutting line. This known cutting device has a rotating knife disk which presses against a counterpart knife, and from which a number of knives radially protrude.

This known apparatus has an improved cutting quality, compared with another known cutting device in which a rotating knife disk and a counterpart rotating knife disk have circular blades, which are suitable for trimming only relatively thin printed products.

SUMMARY OF THE INVENTION

It is an object of the present invention to provide a method and apparatus for trimming printed products along a predetermined cutting line, so that a high output and the necessary cutting quality are attained, along with a gentle handling of the printed products.

The above and other objects are accomplished according to the invention in the context of the method first mentioned above by the provision of a step of moving the two knives in cutting engagement with one another in a direction that is substantially perpendicular to the plane of the printed products.

The method according to the invention is especially advantageous if the predetermined cutting line is disposed parallel or transverse to the feed direction of the printed products, so that the top and bottom edge, and the front edge of the printed products can be easily trimmed. Preferably, the top and bottom trimming is done parallel to the feed direction, and the front trimming is done transverse to the feed direction.

Advantageously, at least one of the knives, and preferably both knives, is additionally moved in the feed direction of the printed products, so that the cutting engagement of the knives is temporally prolonged, and is performed over an approximately common path of motion of the knives, i.e., the cutting path. This advantageously improves the cutting quality, and provides a continuous throughput of the printed products.

If the motion and speed of the printed products and knives are approximately equal during the cutting engagement or cutting operation, then an optical cutting quality of the printed products is obtained with essentially problem-free throughput.

According to another aspect of the invention there is provided an apparatus for trimming flat printed products along a predetermined cutting line, comprising: a conveyor means for continuously feeding the printed products in succession in a feed direction parallel to a plane defined by the printed products; at least one cutting device having two superposed knives, each knife having a cutting edge facing the other cutting edge, the printed products being passed by the conveyor between the two knives; and drive means for moving at least one of the knives in cutting engagement with the other knife in a direction that is substantially perpendicular to the plane of the printed products.

The aforementioned apparatus results in an optimal cutting quality, along with a gentle manipulation of the printed products.

To provide one or more cuts, advantageously the cutting edges of the two knives are parallel to the feed direction.

Alternatively, the knives are arranged with their cutting edges transverse to the feed direction. This configuration is particularly suitable for trimming the front edges of the printed products.

Preferably, the knives have elongated knife blades. Elongated knife blades are stable and reliable, and provide long-lasting cutting quality.

The cutting accuracy can be increased, the service life of the knives lengthened, and the necessary cutting force correspondingly reduced if at least one of the knives is movable back and forth, parallel to the feed direction, by the drive device, so that with the perpendicular motion, the resultant motion is a drawn-out in the same direction as the feed stream.

For this purpose, the drive device preferably comprises at least one crank drive that is coupled wit the cutting device. This crank drive, to attain a cutting direction parallel to the feed direction, preferably has at least two cranks spaced form one another in the feed direction. The knife typically has two ends each pivotally connected to a respective crank.

To make a transverse cut relative to the feed direction, the crank drive, which in the feed direction comprises two spaced-apart cranks, preferably has an actuation member that extends in the feed direction and that is pivotally connected at its ends to the respective cranks. One of the knives is positioned with its cutting edge transverse to the feed direction, and is connected to the actuation member.

To vary the cutting engagement conditions of the knives, at least one of the knives is fixably adjustable.

To drive the cranks of a crank drive in the same direction, a common drive wheel, i.e., an intermediate wheel, is positioned between two cranks and is in engagement thereto.

To attain an essentially transition-free feed stream of printed products during the cutting operation, and/or to stabilize the printed products immediately before and during the cutting operation, it is advantageous if the cranks associated with one knife are controlled to trail the cranks associated with the other knife relative to the cutting engagement of the knives.

Because the cutting conditions vary depending on the thickness and other properties of the printed products, and to attain optimal cutting quality, it is preferred that the lagging of the cranks of one knife be adjustable.

Preferably, the cranks or the knives of a cutting device, and the conveyor, have approximately the same speed in a region of the cutting engagement of the knives.

So that one knife, and preferably the lower knife, and form a support for the printed products during the cutting operation, the conveyor, which comprises endlessly revolving belts, and the upper edge of the one knife, are essentially coplanar during the cutting engagement of the knives.

It is advantageous if the printed products in the cutting region of the conveyor, i.e., in a region lateral of the knives, are broadly supported. To accomplish this, the cutting region of the conveyor has a guide device for supporting the endlessly revolving belts of the conveyor.

To avoid uneven centrifugal forces, the cranks of the crank drives are each connected to one respective counterweight attached to the crankshaft.

Preferably, the printed products are fed in a region of the cutting device using a controlled gripper, which revolves synchronously with the crank drive.

The conveyor comprises, inter alia, an endlessly revolving belt with stops that define the relative position of the printed products with respect to the cutting device. The leading edge (fold edge) of the printed products is held in contact against a respective stop.

To perform the front trimming of the printed products while maintaining a continuous feed stream without changing the position of the printed products, a transporter is provided that comprises a plurality of gripper secured to at least one transport chain. The transporter has a forward receiving end extending over a discharge end of the conveyor.

To improve contact in the cutting region, preferably one knife has a support face.

In view of the required high cutting quality, a holding-down device is provided. The holding-down device is located opposite to one of the knives for pressing upon the printed products.

Because of the different sizes of printed products, the cutting devices for trimming the top and bottom of the printed products are located facing one another on opposite sides of the conveyor. The cutting devices are laterally adjustably spaced from each other using a guide arrangement connected to the machine stand.

Advantageously, a cutting system may comprise two facing cutting devices each arranged parallel to the conveyor, and each being laterally spaced from the other on opposite sides of the conveyor, for trimming a top and bottom of the printed products. An additional cutting device is located downstream of the two facing cutting devices relative to the feed direction, for trimming a front of the printed products. The cutting devices provide for a continuous cutting operation of the printed products. Such an arrangement is well suited for performing a triple edge trimming, i.e., trimming the top, bottom and front edges of the printed products.

Of course, a cutting system in which the cutting devices are arranged in reverse order can also perform the intended cutting.

Instead of changing the order of cutting devices, a cutting system comprising two facing cutting devices each arranged parallel to the conveyor, and each being laterally spaced from the other on opposite sides of the conveyor, for trimming a top and bottom of the printed products can be provided. An additional cutting device is located downstream of the two facing cutting devices relative to the feed direction, for trimming a front of the printed products. The cutting devices provide for a continuous cutting operation of the printed products. A deflector device is located between the two facing cutting devices and the additional cutting device for changing a direction of a feed stream of the printed products. The additional cutting device may be located opposite a fold of the printed products.

The invention will be described below in greater detail in connection with embodiments thereof that are illustrated in the drawing figures.

DETAILED DESCRIPTION OF THE INVENTION

Figure 1:
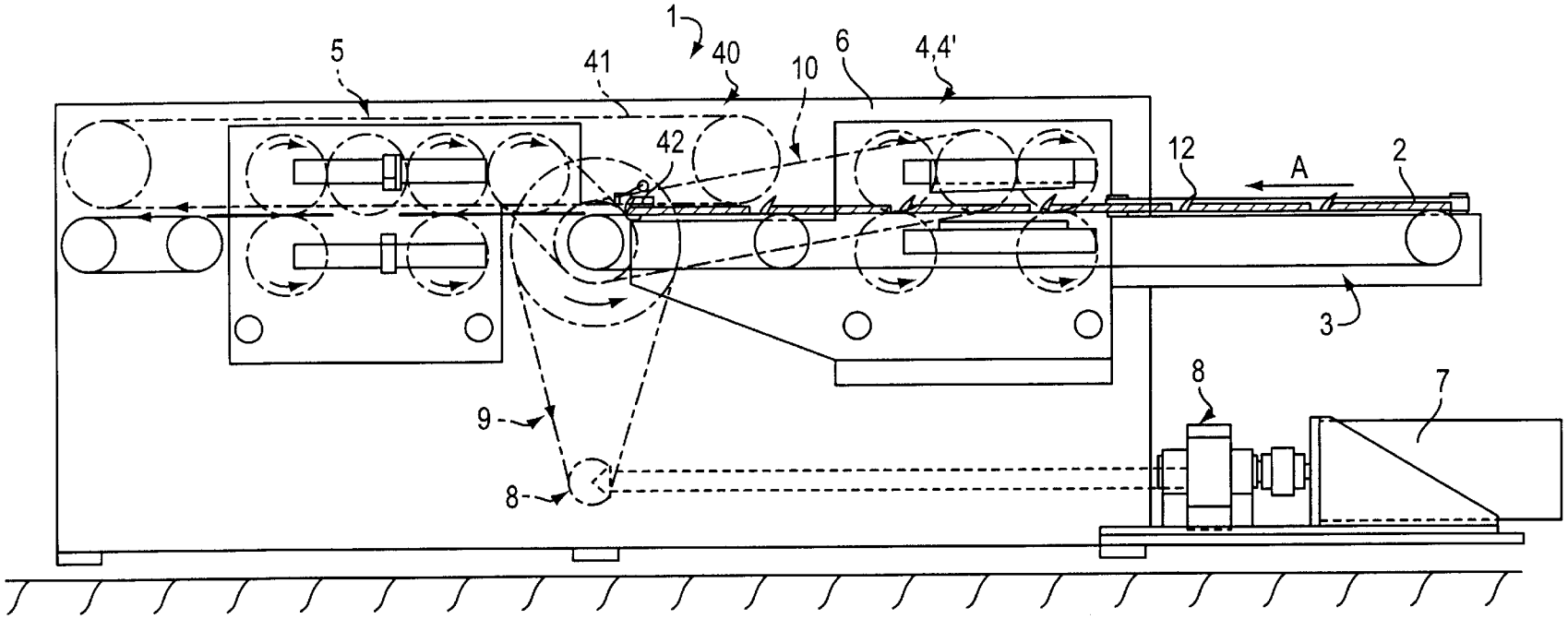
FIG. 1 is a schematic side view of a cutting system for printed products according to the invention.

Referring to FIG. 1, a cutting system 1 is illustrated. Cutting system 1 is supplied in a feed direction, represented by arrow A on the right-hand side of the figure, with printed products 2, folded side first, using a conveyor 3. Conveyor 3 comprises at least two laterally spaced apart, endless revolving belts.

The cutting system 1, relative to the feed direction A, comprises a cutting device 4, 4' for edge trimming the bottom and/or to of a printed product 2. Cutting device 4, 4' is followed by a cutting device 5 for trimming the front edge of the printed products 2. The printed products are fed so that they follow one another at intervals. Thus, the processing of the printed products 2 in the cutting system 1 takes place in a cadenced fashion, between conveyor 3 and the cutting devices 4, 4' and 5.

The cutting system 1 is built into a machine stand 6, and is driven by a variable-rpm motor 7. Gear drives 8 and traction mechanisms 9 are provided for drivably connecting the motor 7 to the cutting devices 4, 4' and 5. FIG. 1 sufficiently illustrates the drive and connections, without requiring additional explanation.

Figure 2:
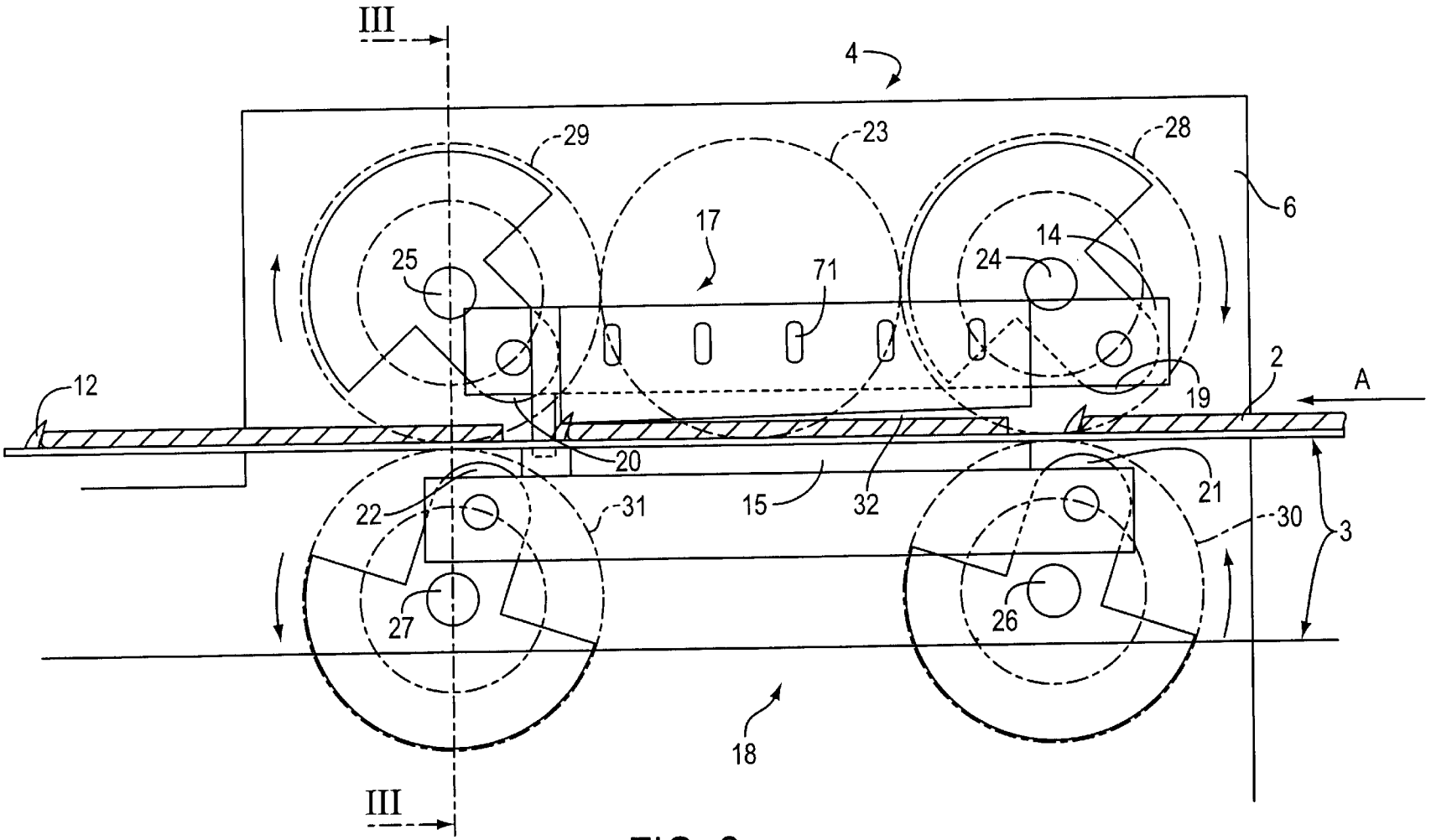
FIG. 2 is a detailed enlarged side view of a first cutting device on an inlet side of the cutting system of FIG. 1.
Figure 3:
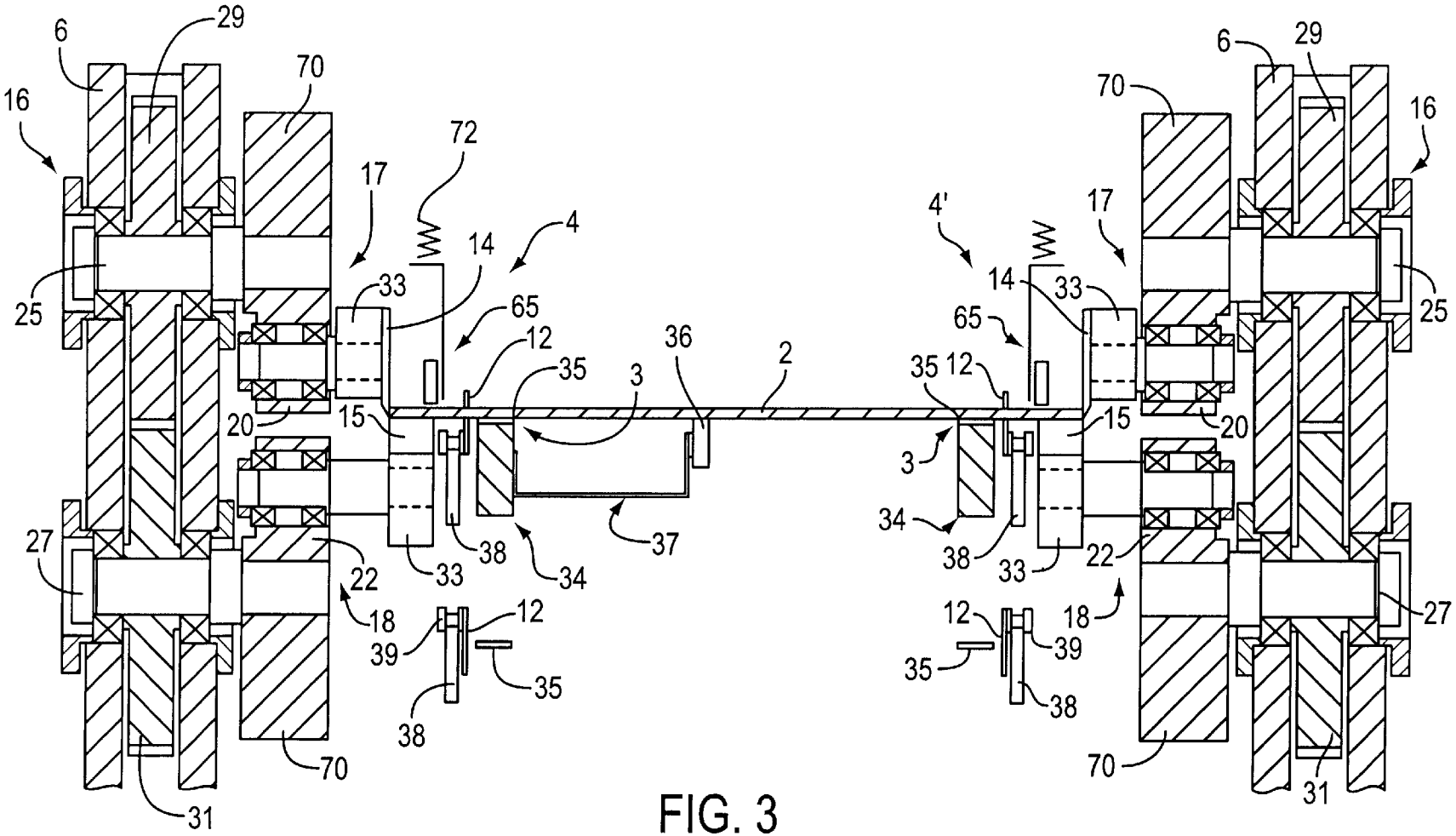
FIG. 3 is a cross section taken along the like III—III of FIG. 2 of the first cutting device.

FIG. 2 shows the cutting device 4, which is directly driven by a belt drive 10. FIG. 3 illustrates the cutting devices 4, 4' in further detail.

As shown, the cutting devices 4, 4' are embodied for trimming the top or bottom of a printed product 2, and are laterally spaced apart from each other. Typically, prior to being cut, the printed product is straightened and aligned relative to the predetermined cutting lines by a centering device and accelerator device (not shown). The centering device can comprise, for example, revolving belts that act laterally upon the printed products 2. The accelerator device accelerates the revolving belts, superimposing the feeding speed of the conveyor onto the speed of the revolving belts, thus aligning and straightening the printed products.

The printed products are placed one after the other on the conveyor 3. The rear edge of each printed product 2 is in contact with a stop 12, which is attached to a revolving conveyor chain, which will be subsequently explained in greater detail.

The cutting devices 4, 4' for the top and bottom trimming, respectively, each comprise two superposed knives 14, 15, each knife having a respective edge 14*a*, 15*a* facing the other edge. The decollated printed products 2 are moved by the conveyor 3, and passed between the superposed knives 14, 15.

The knives 14, 15 are moved by a drive device 16, to be described below, into cutting engagement with each other. The motion of the knives 14, 15, located with their respective edges 14*a*, 15*a* parallel to the feed direction A of the conveyor 3, is essentially perpendicular to the plane of the printed products 2. Further, the knives 14, 15 are moved during their cutting engagement in the same direction as, and together with, the printed products 2.

The knives are embodied as elongated knife blades, and as noted above, are moved back and forth parallel to the feed direction by the drive device 16.

To accomplish this movement of the knives, each drive device 16 is provided with two crank drives 17 and 18, each of which is associated with one knife 14, 15. Each crank drive 17, 18 has two cranks 19, 20, and 21, 22, respectively. The cranks of each respective crank drive are spaced apart from each other relative to the feed direction A of the conveyor 3. Each crank is pivotally connected to a respective end of one of the knives 14, 15.

The crank drives 17, 18 move the respective knives in an even oscillatory motion, due to an equal-angle rotary motion of two cranks 19, 20 and 21, 22, respectively. As noted above, the cranks 19–22 are connected in pairs to each respective knife 14, 15.

A common drive wheel 23 is provided for imparting the equal-angle rotary motion to the cranks, and for ensuring that the cranks are rotated in the correct rotary direction. Drive wheel 23 is located between the two cranks 19, 20, or the cranks 21, 22. In the exemplary embodiment shown in FIGS. 1 and 2, this drive wheel 23 is located between the cranks 19, 20.

As additionally illustrated in FIG. 3, the crank drives 17, 18 for the cutting devices 4, 4' (for the respective top and bottom trimming) further include gear wheels 28–31. The gear wheels are each provided with the same pitch diameter and number of teeth, and are secured to respective crankshafts 24–27.

FIG. 2 illustrates that the cranks 19, 20 of one knife 14 have different rotary positions on their crankshafts 24, 25, compared with the rotary positions of cranks 21, 22 on their crankshafts 26, 27. As a result, the lower knife 15 reaches its highest, i.e., culmination, position before the upper knife 14 reaches its lowest position, i.e., the position for maximum cutting engagement. Thus, the cranks 19, 20 associated with the knife 14 are driven in a controlled manner to trail the cranks 21, 22 associated with the knife 15, thus ensuring the optimum cutting engagement motion of the cutting devices 4, 4'.

The aforementioned trailing is possible due to the mutual rotatability of the respective cranks 20, 22 and 19, 21 using the respective gear wheels 29, 31 and 28, 30, and can be adapted, i.e. adjusted to the properties of the printed product 2 and to the required cutting operation.

Because the cranks 19, 21 and 20, 22, and thus the knives 14, 15, have approximately the same speed in their approach region towards the printed product 2 (such speed being approximately equal to the speed of conveyor 3) there is a resultant cutting path along which the cutting engagement takes place.

So that the printed products 2 will rest smoothly on conveyor 3 directly prior to the cutting, during the cutting engagement the conveyor 2 and the upper edge 15*a* of the knife 15 form an approximately coplanar plane. Further, knife 15 may have a support face 15*c*, so as to provide additional support for the printed products. FIG. 2 shows that the upper edge 15*a*, before reaching its uppermost position and immeidately before cutting begins, has reached the coplanar plane. Upon reaching its uppermost position, upper edge 15*a* exerts a cutting motion as a result of being slightly raised above the plane of the conveyor. Thus, the cutting devices are adaptable, and can trim the printed products in a variety of selected conditions.

As also illustrated in FIG. 2, knives 14, 15 form therebetween a cutting gap 32, which gradually narrows in the feed direction A. The cutting gap 32 has an entry angle $\alpha$ that can be varied using an adjusting and fixing device 71. Thus, the entry angle can be adjusted depending on the properties of the printed products 2 to be cut. As the entry angle $\alpha$ is reduced, the cutting and feeding power acting upon the printed products 2 is increased.

Adjusting and fixing device 71 adjustably secures knife 14 on a beam 33 that is pivotally connected on both its ends to the cranks 19, 20. Beam 33 is provided over its length with threaded holes, and knife 14 includes a plurality of vertical slits 72, each being in registration with a respective threaded hole. To adjust the entry angle $\alpha$, the knife is positioned in its desired location, and screws (not shown) are passed through vertical slits 72, and into the threaded holes, securing the knife 14 to the beam 33. Alternatively, knife 14 can be permanently affixed to beam 33, i.e., knife 14 and beam 33 form an integral unit.

As noted above, conveyor 3 comprises at least two laterally spaced apart, endlessly revolving belts 35. These belts 35 are typically supported on a guide device 34.

Further, an additional support device 37 may be provided, that comprises a series of rollers 36 in succession along the longitudinal center axis of the cutting system 1.

As mentioned earlier, the stop 12 is attached to a revolving conveyor chain 39. A guide arrangement 38 is provided for guiding chain 39.

To reduce any imbalance in the bearings arising from the crank motion, and to reduce the resultant noise, compensating counterweights 70 are secured on the respective crank shafts 24–27 opposite to the respective crank 19–22.

Preferably, the cutting device 4, 4' are adjustable relative to each other in a direction transverse to the feed direction A. Thus, the spacing between the respective cutting devices 4, 4' can be increased or decreased so that the tops and bottoms of various sized printed products can be trimmed. To adjust this spacing, a guide arrangement that, with the machine stand 6, operates transverse to the feed direction A may be provided (not shown). The cutting devices 4, 4' can be adjusted and fixed in the desired position using this arrangement, ether individually or jointly, for example by using a spindle drive.

Figure 4:
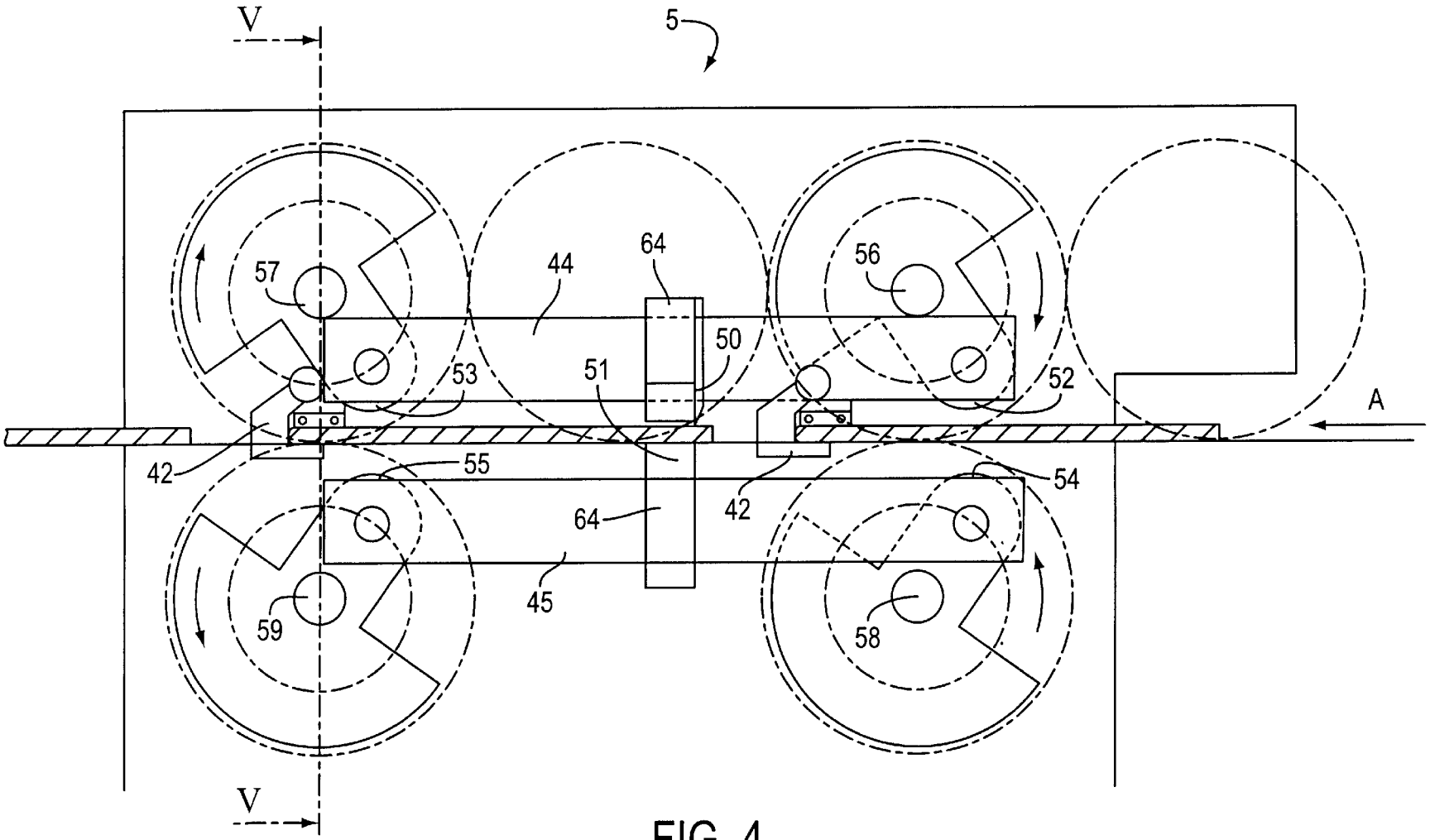
FIG. 4 is a detailed enlarged side view of a second cutting device of the cutting system of FIG. 1.
Figure 5:
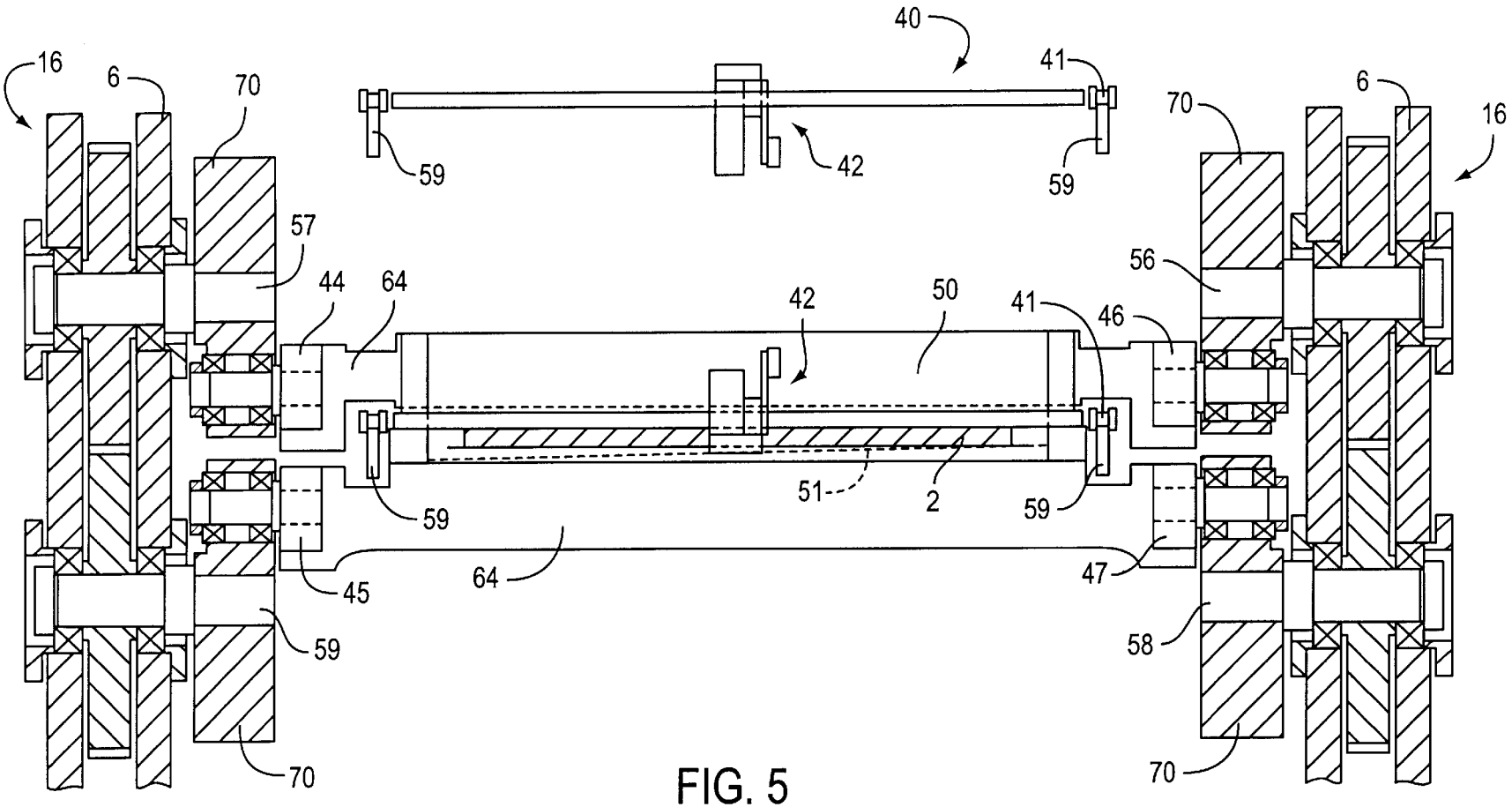
FIG. 5 is a cross section taken along the line V—V of FIG. 4 of the second cutting device of the cutting system.

FIGS. 4 and 5 show a cutting device 5 provided for trimming the front edge of the printed products 2. Cutting device 5 forms a part of a continuous passage for the printed products 2, and receives the printed products transferred from the cutting devices 4, 4'.

The transfer, which is preferably but not necessarily performed in a cadenced manner, is accomplished using the conveyor 3, which extends in the feed direction A beyond the cutting devices 4, 4'. The transfer is further performed using a transporter 40 that cooperates with the discharge end of conveyor 3, and that includes a revolving transport chain 41. Transporter 40 extends approximately along the vertical longitudinal center plane of the cutting system 1, and is driven using the traction mechanism 9. The disposition and cooperation of the conveyor 3 with the transporter 40 is shown in FIGS. 1 and 5.

Grippers 42, that are actuatable by control devices, are secured to the revolving transport chain 41 at equal intervals. With the folded side leading, the printed products 2 are pushed or supplied by the conveyor 3 to the open grippers 42, located at the discharge point of the conveyor 3. When supplied with a printed product 2, and on the initiation of a control device, a spring force causes the grippers to close. The printed products 2 are then moved or pulled through the cutting device 5 on a guide table 43, which is uninterrupted in the cutting engagement region of the cutting device 5.

The cutting device 5 adjoins the cutting devices 4, 4', and differs from cutting devices 4, 4' in that its knives 50, 51 are disposed with their cutting edges 50*a*, 51*a* extending transverse to the feed direction A. In other words, in a manner similar to cutting devices 4, 4', cutting device 5 includes two cooperating crank drives 48, 49 on each side of the feedpath of printed products 2.

Each crank drive includes a respective crank 52–55, which are pivotally connected together by respective actuation members 44–47. Thus, on each side of the cutting device 5, crank 52 is connected to crank 53, and crank 54 is connected to crank 55.

However, in contrast to the crank drives 17, 18, the crank drives 48, 49 on one side of the cutting device 5 are additionally connected to the opposite crank drives, i.e., the crank drive located on the opposite side of cutting device 5 by the respective knives 50, 51, which are secured to respective actuation members 44–47, i.e., knife 50 is secured to actuation members 44 and 46, and knife 51 is secured to actuation members 45 and 47.

Further, in contrast to the different angular positions between cranks 19 and 21, and cranks 20 and 22, the angular positions of the cranks 52–55 are symmetrically oriented on the crank shafts 56–59 in pairs. Thus, the crank 52 on one side of the cutting device 5 has essentially the same angular position as the crank 52 on the other side of the cutting device. As a result, the knives 50, 51 form a cutting plane that extends transverse to the feed direction A, and are movable in an oscillatory manner in the feed direction. Thus, the actual cutting is performed along a resultant path that is parallel to the feed direction. Along this path, the printed products 2 move at least as fast as the knives 50, 51. Further, since the angular positions of the cranks 52–55 are all essentially the same, the knives 50, 51 remain essentially parallel during their revolving motion.

An upper and a lower transverse beam 64, 64' receives the knives 50, 51 for attaching the knives to the respective actuation members 44–47. The lower beam 64' forms a support or rest for the printed products 2 during cutting.

To stabilize the printed products, a holding-down device 65 (shown only schematically in FIG. 3) presses the printed products 2 against the top side of the beam 33 or 64', and preferably extends over at least the cutting path. The holding-down device is provided with a plurality of press rollers 65' lined up side by side in the feed direction, which are pressed against the printed products 2, for example, counter to a spring force accumulator 72.

The cutting device 5 is driven via drive pinions 60. An intermediate wheel 61 provides that all of the cranks 52–55 are rotated in the appropriate direction.

As shown in FIG. 5, transporter 40 comprises two transport chains 41, each extending laterally of the vertical longitudinal center plane and each joined together by a spacer 62 that is oriented transversely. Spacer 62 carries the grippers 42. The transport chains 41, disposed outside the cutting range of the cutting device 5, are supported on stationary guide ribs 63.

Figure 6:
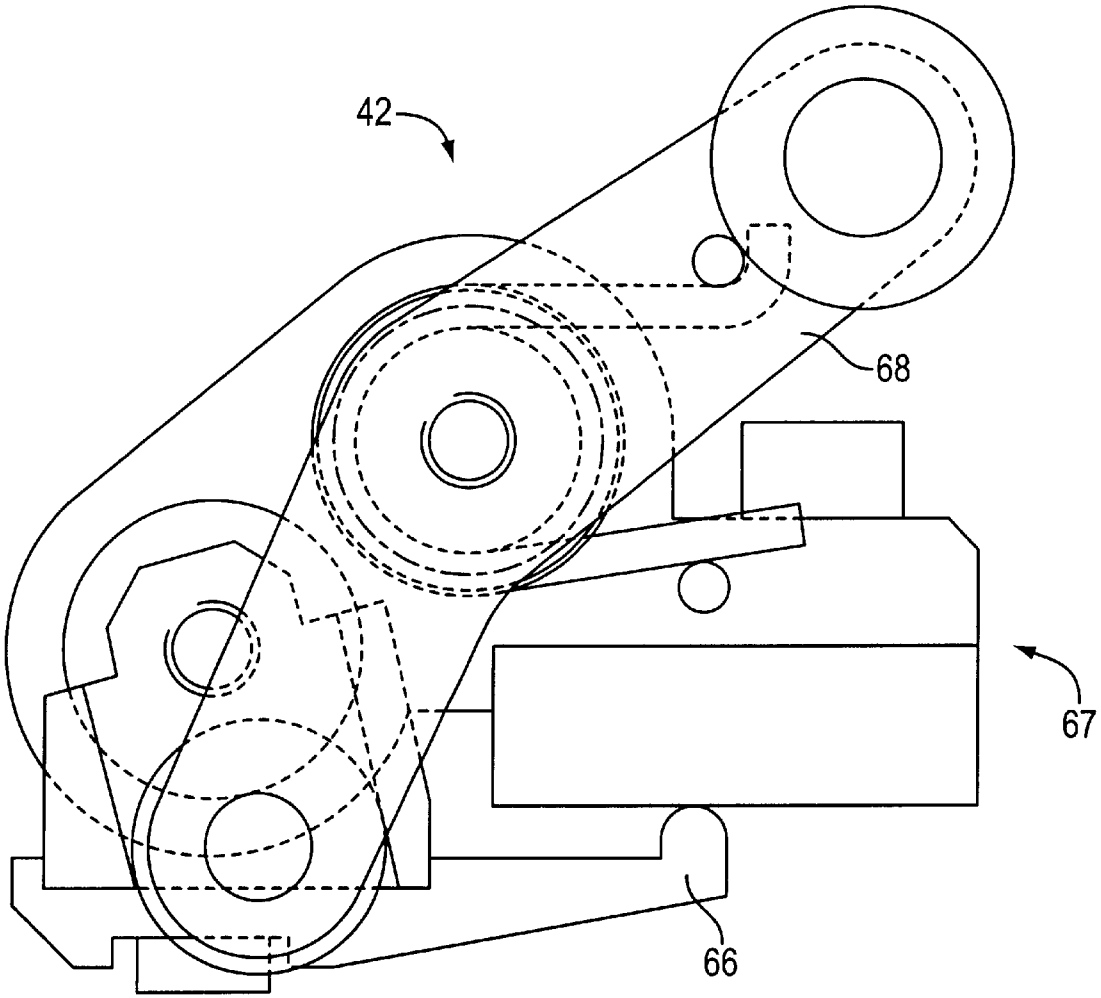
FIG. 6 is a front view of a gripper according to the invention.

FIG. 6 shows an embodiment of a gripper 42 in a closed position, in which a movable gripper part 66 is pressed against a stationary gripper part 67, the latter being connected to the transport chains 41. The closure of the gripper 42 is effected by a spring force. The gripper 42 is opened counter to the spring force using a double lever 68 that runs along a control path.

Figure 7:
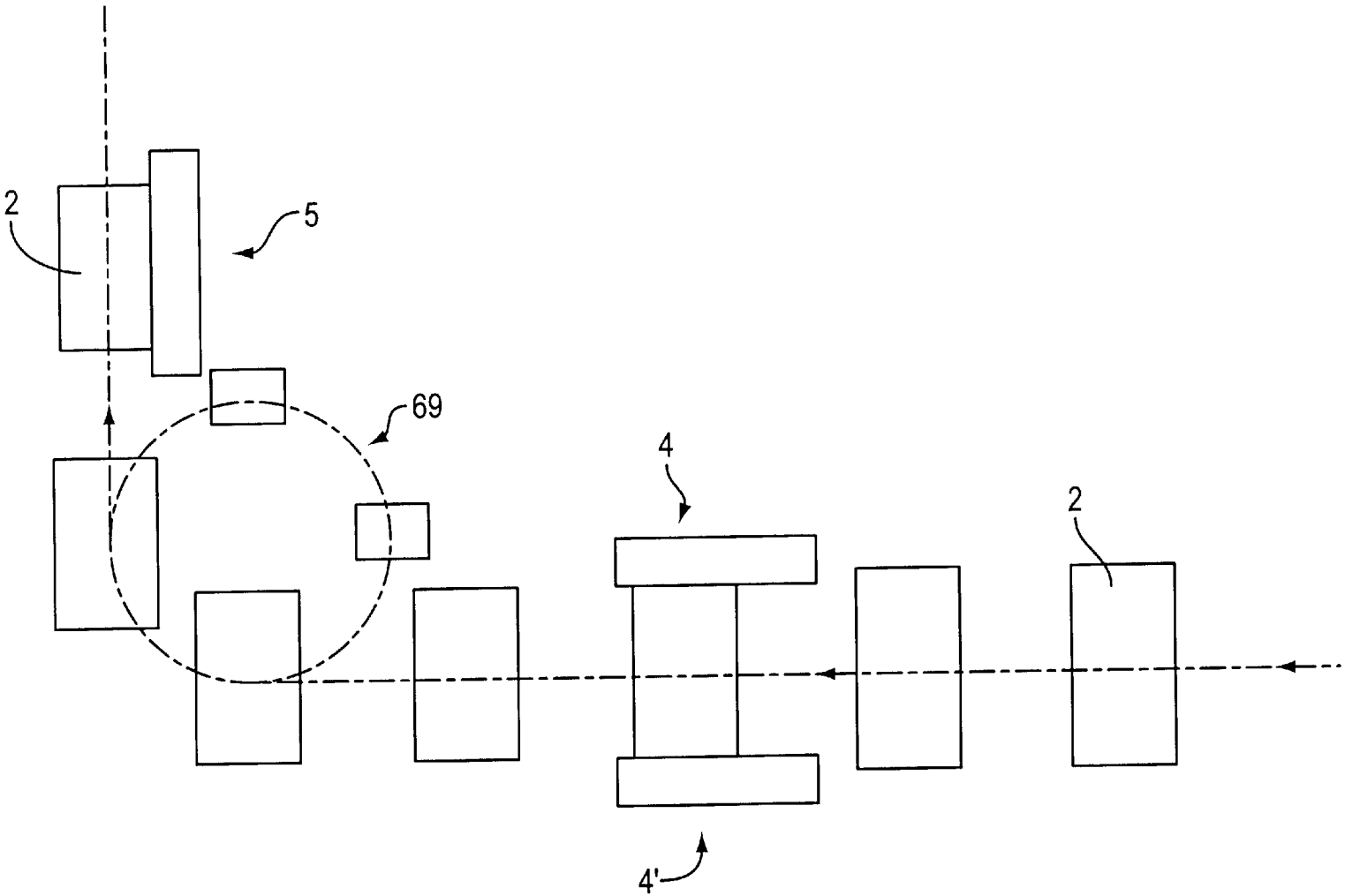
FIG. 7 is a schematic of an alternative embodiment of a cutting system for printed products according to the invention.

Instead of arranging the cutting devices 4, 4', 5 as shown in FIG. 1, the cutting devices can alternatively be set up for trimming the top/bottom and front edge of a printed product as shown in FIG. 7. In this embodiment, the cutting devices 4, 4' are disposed at right angles to cutting device 5 relative to the feed direction of the printed products 2.

A deflector device 6 is located between the cutting devices. The deflector device shifts the printed products after the top/bottom trimming operation to a feed direction that is altered by 90°. The deflector device 69 may be embodied as a rotating carrier device with grippers secured to the circumference. The printed products, after being trimmed at the top and bottom, are delivered to the grippers by conveyor 3, and after deflection, are discharged to a transporter 40 for the ensuing front edge trimming, as approximately shown in FIGS. 1–6. Alternatively, instead of a carrier device with grippers, a deflection roller may be provided, by which the grippers, secured to an endless transport chain, are guided to the next cutting device for the front edge trimming.

Such as embodiment advantageously uses the same type of cutting device for trimming the top and/or the bottom of the printed product, as well as for trimming the front edge of the printed products 2.

The invention now being fully described, it will be apparent to one of ordinary skill in the art that any changes and modifications can be made thereto without departing from the spirit or scope of the invention as set forth herein.

What is claimed is:

1. A method for trimming flat printed products along a predetermined cutting line, comprising the steps of:

continuously feeding the printed products in succession in a feed direction parallel to a plane defined by the printed products;

passing the printed products between two superposed knives having oppositely disposed cutting edges; and moving the two knives in cutting engagement with one another in a direction that includes a component perpendicular to the plane of the printed products and a movement component that is in the feed direction so that a continuous feed flow of the printed products is maintained during the trimming.

2. The method defined in claim 1, wherein the feed direction of said feeding step is essentially parallel to the predetermined cutting line.

3. The method defined in claim 3, wherein the feed direction of said feeding step is essentially transverse to the predetermined cutting line.

4. The method defined in claim 1, wherein at least one of the knives of said moving step is additionally moved in the feed direction of the printed products.

5. The method defined in claim 4, wherein the printed products of said passing step are moved at a first speed; the at least one knife of said moving step being moved in the feed direction of the printed products at a second speed essentially equal to the first speed.

6. An apparatus for trimming flat printed products along a predetermined cutting line, comprising:

conveyor means for continuously feeding the printed products in succession in a feed direction parallel to a plane defined by the printed products;

at least one cutting device having two superposed knives having oppositely disposed cutting edges, the printed products being passed by said conveyor means between said two knives; and drive means for moving each of the knives in cutting engagement with the other knife in a direction that includes a component perpendicular to the plane of the printed products and a movement component that is in the feed direction to maintain a continuous feed flow during the trimming.

7. The apparatus defined in claim 6, wherein the cutting edges of said two knives are parallel to the feed direction.

8. The apparatus defined in claim 7, wherein said rive means moves at least one knife in a back and forth motion parallel to the feed direction.

9. The apparatus defined in claim 6, where in the cutting edges of said two knives are transverse to the feed direction.

10. The apparatus defined in claim 9, wherein said drive means moves at least one knife in a back and forth motion parallel to the feed direction.

11. The apparatus defined in claim 6, wherein each said knife has an elongated knife blade.

12. The apparatus defined in claim 11, wherein said drive means comprises at least one crank drive coupled with said cutting device.

13. The apparatus defined in claim 12, wherein said crank drive comprises at least two cranks spaced from one another in the feed direction, and wherein the cutting edges of said two knives are parallel to the feed direction; at least one of said knives having two ends each pivotally connected to a respective crank.

14. The apparatus defined in claim 13, wherein at least one of said two knives is fixedly adjustable.

15. The apparatus defined in claim 13, wherein said drive means comprises a common drive wheel located between said at least two cranks.

16. The apparatus defined in claim 12, wherein said crank drive comprises at least two cranks spaced from one another in the feed direction, and an actuation member having two opposite ends each pivotally connected to a respective crank, and wherein the cutting edges of said two knives are transverse to the feed direction; one of said knives being connected to said actuation member.

17. The apparatus defined in claim 16, wherein said drive means comprises a common drive wheel located between said two cranks.

18. The apparatus defined in claim 12, wherein said crank drive comprises a first pair of cranks spaced from one another in the feed direction, and a second pair of cranks spaced from one another in the feed direction; one of said knives being connected to said first pair of cranks, and the other of said knives being connected to said second pair of cranks; further comprising control means for controlling said first pair of cranks so as to trail said second pair of cranks relative to the cutting engagement of said knives.

19. The apparatus defined in claim 18, wherein said control means includes means for adjusting a lag time defined by the trailing.

20. The apparatus defined in claim 12, wherein at least one knife is moved at a speed approximately equal to a speed of said conveyor means in a region of the cutting engagement of said knives.

21. The apparatus defined in claim 12, wherein said conveyor means comprises a plurality of endlessly revolving belts, and wherein an upper edge of one of said knives is essentially coplanar with said endlessly revolving belts during the cutting engagement of said knives.

22. The apparatus defined in claim 21, wherein said conveyor means defines a cutting region, and further comprises a guide device in the cutting region for supporting said endlessly revolving belts.

23. The apparatus defined in claim 12, wherein said at least one crank drive comprises a plurality of crank shafts, a plurality of cranks each attached to a respective crank shaft, and a plurality of counterweights each connected to a respective crank.

24. The apparatus defined in claim 22, wherein said at least one cutting device comprises at least two successively arranged cutting devices; and wherein said conveyor means comprises a controlled gripper for feeding the printed products from one of said cutting device to the other of said cutting devices, said controlled gripper revolving synchronously with said crank drive of the other cutting device.

25. The apparatus defined in claim 6, wherein said conveyor means comprises an endlessly revolving belt having a plurality of steps for fixing a position of the printed products relative to said at least one cutting device by holding a leading edge of the printed product in contact with the respective step.

26. The apparatus defined in claim 6, wherein said conveyor means comprises a first conveyor, and a transporter having at least one transport chain and a plurality of grippers secured to said at least one transport chain, said transporter having a forward receiving and extending over a discharge end of said conveyor.

27. The apparatus defined in claim 6, wherein one of said knives includes a support face for supporting the printed products during the cutting engagement.

28. The apparatus defined in claim 7, further comprising a holding-down device located opposite to one of said knives for pressing upon the printed products.

29. The apparatus defined in claim 6, wherein said at least one cutting device comprises two cutting devices each arranged parallel to said conveyor means, and each being laterally adjustably spaced from the other on opposite sides of said conveyor means.

30. The apparatus defined in claim 6, wherein said at least one cutting device comprises two facing cutting devices each arranged parallel to said conveyor means, and each being laterally spaced from the other on opposite sides of said conveyor means, for trimming a to and bottom of the printed products; said at least one cutting device further comprising an additional cutting device located downstream of said two facing cutting devices relative to the feed direction, for trimming a front of the printed products, said cutting devices providing for a continuous cutting operation of the printed products.

31. The apparatus defined in claim 6, wherein said at least one cutting device comprises two facing cutting devices each arranged parallel to said conveyor means, and each being laterally spaced from the other on opposite sides of said conveyor means, for trimming atop and bottom of the printed products; said at least one cutting device further comprising an additional cutting device located downstream of said two facing cutting devices relative to the feed direction, for trimming a front of the printed products, said cutting devices providing for a continuous cutting operation of the printed products; said apparatus further comprising a deflector device located downstream said two facing cutting devices and upstream of said additional cutting device for changing a direction of a feed stream of printed products, the additional cutting device being located opposite a fold of the printed products.

* * * * *